US009468059B2

(12) United States Patent
Hong

(10) Patent No.: US 9,468,059 B2
(45) **Date of Patent: *Oct. 11, 2016**

(54) LIGHT EMITTING DEVICE DRIVING APPARATUS AND ILLUMINATION SYSTEM INCLUDING THE SAME

(71) Applicant: Dongbu HiTek Co., Ltd., Bucheon-si (KR)

(72) Inventor: Seung Hun Hong, Namyangju-si (KR)

(73) Assignee: Dongbu HiTek Co., Ltd., Bucheon-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/631,202

(22) Filed: Feb. 25, 2015

(65) Prior Publication Data

US 2015/0351182 A1 Dec. 3, 2015

(30) Foreign Application Priority Data

May 28, 2014 (KR) ..... 10-2014-0064197

(51) Int. Cl.
*H05B 33/08* (2006.01)

(52) U.S. Cl.
CPC ..... *H05B 33/083* (2013.01)

(58) Field of Classification Search
CPC ..... H05B 33/0815; H05B 33/0818; H05B 33/083; H05B 33/0824; H05B 33/0851; H05B 33/0827; H05B 37/02
USPC ..... 315/295, 294, 121, 297, 307, 312
See application file for complete search history.

(56) References Cited

U.S. PATENT DOCUMENTS 7,505,702 B2 3/2009 Hong
7,715,738 B2 5/2010 Hong
8,680,782 B2 * 3/2014 Sakuragi ..... H05B 33/083 315/185 S (Continued)

FOREIGN PATENT DOCUMENTS

KR 100648931 B 11/2006
KR 10-1068075 B 9/2011

(Continued)

OTHER PUBLICATIONS

Office Action dated Oct. 8, 2015 for Korean Patent Application No. 069510418; 6 pgs.; Korean Intellectual Property Office, Republic of Korea.

(Continued)

*Primary Examiner* — Douglas W Owens
*Assistant Examiner* — Wei Chan
(74) *Attorney, Agent, or Firm* — Andrew D. Fortney; Central California IP Group, P.C.

(57) ABSTRACT

Disclosed is a light emitting device driving apparatus configured to control a light emitting unit including light emitting devices or array(s) thereof connected in series. The light emitting device driving apparatus includes a rectifier configured to rectify an AC signal and supply to the light emitting unit a ripple current signal, and a sequential driving controller configured to generate a reference current, compare the reference current with a channel current from the light emitting unit, and selectively connect one of channel lines connected to respective output terminals of the light emitting devices or array(s) thereof. The sequential driving controller adjusts a level and/or value of the reference current based on the ripple current signal. The reference current is a current flowing between the first node and a ground potential.

11 Claims, 9 Drawing Sheets

(56) References Cited

U.S. PATENT DOCUMENTS

| | | | | |
|---|---|---|---|---|
| 8,928,247 | B2 * | 1/2015 | Cheon | H05B 37/02 315/185 R |
| 9,055,639 | B2 * | 6/2015 | Chu | H05B 33/0824 |
| 9,220,140 | B2 * | 12/2015 | Liu | H05B 33/083 |
| 2005/0231459 | A1 * | 10/2005 | Furukawa | G09G 3/3406 345/102 |
| 2007/0071478 | A1 | 3/2007 | Hong | |
| 2008/0150439 | A1 * | 6/2008 | Bucur | H05B 33/083 315/186 |
| 2008/0203946 | A1 * | 8/2008 | Ito | H05B 33/083 315/307 |
| 2010/0109570 | A1 * | 5/2010 | Weaver | H05B 33/0812 315/295 |
| 2010/0134018 | A1 * | 6/2010 | Tziony | H05B 33/083 315/122 |
| 2012/0056544 | A1 * | 3/2012 | Jeong | H05B 33/0824 315/121 |
| 2012/0127214 | A1 | 5/2012 | Han et al. | |
| 2012/0133284 | A1 * | 5/2012 | Ge | H05B 33/089 315/121 |
| 2013/0099671 | A1 | 4/2013 | Horino et al. | |
| 2013/0099683 | A1 * | 4/2013 | Sakuragi | H05B 33/083 315/185 R |
| 2013/0257298 | A1 * | 10/2013 | Cheon | H05B 37/02 315/185 R |
| 2013/0313987 | A1 * | 11/2013 | Chu | H05B 33/0824 315/193 |

FOREIGN PATENT DOCUMENTS

| | | | |
|---|---|---|---|
| KR | 10-2012-0025758 | A | 3/2012 |
| KR | 10-2012-0053783 | A | 5/2012 |
| KR | 10-2013-0035488 | A | 4/2013 |
| KR | 10-1293584 | B1 | 8/2013 |

OTHER PUBLICATIONS

Horino Mamoru et al.; "Power Supply and Driving Device"; Abstract of KR101293584 (B1); Apr. 26, 2013; 1 pg.; http://engpat.kipris.or.kr.

Jae Duk Park; "High Power Control Apparatus for Light Bulb with Fine Tuning High Power Factor Able to Adjust Brightness"; Abstract of KR20130035488 (A); Apr. 9, 2013; 1 pg.; http://worldwide.espacenet.com.

Hee Seok Han et al.; "Circuit and Method of Driving Light Emitting Diodes, and Light Emitting Diode System Having the Same"; Abstract of KR20120053783 (A); May 29, 2012; 1 pg.; http://worldwide.espacenet.com.

Nak Jun Jeong et al.; "Apparatus for Driving Emitting Device"; Abstract of KR20120025758 (A); Mar. 16, 2012; 1 pg.; http://worldwide.espacenet.com.

Sang Ik Jeong; "Current Control Apparatus for LEDS"; Abstract of KR101068075 (B1); Sep. 28, 2011; 1 pg.; http://engpat.kipris.or.kr.

Office Action dated Apr. 28, 2016 for Korean Patent Application No. 10-2014-0064197; 7 pgs.; Korean Intellectual Property Office, Republic of Korea.

Hyung Won Hong; "High Power Supply Apparatus for Controlling Strangeness Load"; Bibliographic data of KR100648931 (B1); Nov. 16, 2006; 2 pgs.; http://worldwide.espacenet.com.

* cited by examiner

LIGHT EMITTING DEVICE DRIVING APPARATUS AND ILLUMINATION SYSTEM INCLUDING THE SAME

This application claims the benefit of the Korean Patent Application No. 10-2014-0064197, filed on May 28, 2014, which is hereby incorporated by reference as if fully set forth herein.

BACKGROUND OF THE INVENTION

1. Field of the Invention

Embodiments of the present invention relate to a light emitting device driving apparatus and an illumination system including the same.

2. Discussion of the Related Art

In accordance with development of semiconductor technologies, efficiency of light emitting diodes (LEDs) has been greatly enhanced. Thus, LEDs have advantages of being economical and environmentally friendly due to long lifespan and low energy consumption thereof, as compared to existing lighting devices such as incandescent lamps or fluorescent lamps. By virtue of such advantages, LEDs are highlighted as a substitute light source for a backlight of a flat display device such as a liquid crystal display (LCD) or a signal lamp.

Generally, when LEDs are used as a lighting device, plural LEDs may be connected in series or in parallel, and the LEDs may be turned on and off by a light emitting device control apparatus.

Generally, a light emitting device control apparatus that controls plural LEDs rectifies an alternating current (AC) voltage into a ripple voltage. The LED control apparatus controls turn-on and turn-off of the plural LEDs using the rectified ripple voltage.

SUMMARY OF THE INVENTION

Embodiments of the present invention provide a light emitting device driving apparatus, which is capable of protecting a switch, achieving an improvement in AC power noise tolerance, preventing an illumination system from being turned off or flickering in an abnormal situation such as a fire, and enabling the illumination system to emit a normal amount of light when turned on after turning-off thereof.

Additional advantages, objects, and features of the embodiments will be set forth in part in the description which follows and in part will become apparent to those having ordinary skill in the art upon examination of the following or may be learned from practice of the embodiments. The objectives and other advantages of the embodiments may be realized and attained by the structure particularly pointed out in the written description and claims hereof as well as the appended drawings.

To achieve these objects and other advantages and in accordance with purpose(s) of the embodiments, as embodied and broadly described herein, a light emitting device (LED) driving apparatus may include a rectifier configured to rectify an AC signal and supply to a light emitting unit a ripple current signal (e.g., as a result of rectifying the AC signal), and a sequential driving controller configured to generate a reference current, compare the reference current with a channel current from the light emitting unit to a first node, and selectively connect a channel line (e.g., one of a plurality of channel lines connected to respective output terminals of the light emitting devices or array[s] thereof), based on a result of comparing the reference current with the channel current, wherein the sequential driving controller adjusts a level or value of the reference current based on a level of the ripple current signal, and the reference current comprises a current between the first node and a ground potential. The LED driving apparatus may control a light emitting unit including a plurality of light emitting devices (or one or more arrays of LEDs) connected in series.

The sequential driving controller may include a switch driver configured to selectively connect the channel line(s) and the first node in response to one or more control signals, and a switching controller configured to generate the control signal(s) based on the result of comparing the reference current and the channel current.

The first node may be directly connected to a last one of the output terminals of the light emitting devices or array(s) thereof.

The sequential driving controller may include a plurality of switches configured to be switched (e.g., turned on and/or off) in accordance with the control signal(s), and a switching controller configured to adjust the level and/or value of the reference current based on the level of the ripple current signal, and generate the control signal(s) based on a result of comparing the adjusted reference current and the channel current. Each of the switches may be connected between the first node and a corresponding one of the output terminals of the light emitting devices or array(s) thereof, except for the last output terminal.

The switching controller may include a current controller connected between the first node and a ground potential, the current controller generating the reference current, and a logic controller configured to adjust the level and/or value of the reference current based on the level of the ripple current signal, and generate the control signal(s) based on the result of comparing the adjusted reference current and the channel current.

The current controller may include an amplifier including a first input terminal configured to receive a selection voltage, a second input terminal connected to a second node, and an output terminal; a transistor including a gate connected to the output terminal of the amplifier, and source and drain terminals connected between the first node and the second node; and a variable resistor connected between the second node and the ground potential. The logic controller may vary a resistance of the variable resistor based on the result of comparing the adjusted reference current and the channel current.

The light emitting device driving apparatus may further include a power supply configured to receive the ripple current signal, and generate an internal voltage and a plurality of selective voltages.

The light emitting device driving apparatus may further include a current adjuster configured to convert an analog signal to a digital signal in response to a setting voltage, and output one of the plurality of selective voltages as the selection voltage based on the digital signal.

The current adjuster may include an external resistor connection terminal connected to an external resistor, an internal resistor connected at one end to the external resistor connection terminal AND receiving the internal voltage at another end, an analog-digital converter configured to convert an analog signal to a digital signal in response to the setting voltage, and a selector configured to select and output one of the selective voltages based on the digital signal. The setting voltage may be a voltage at the external resistor connection terminal.

The light emitting device driving apparatus may further include a temperature adapter including a temperature sensing transistor having a base-emitter or gate-source voltage that varies in accordance with a variation in temperature. The temperature adapter may output a thermal shutdown signal, based on the base-emitter or gate-source voltage of the temperature sensing transistor and the internal voltage. The current adjuster may selectively output one of the selective voltages based on the thermal shutdown signal.

The temperature adapter may further include a comparator configured to compare the base-emitter or gate-source voltage of the temperature sensing transistor with a first voltage, and output a temperature sensing signal (e.g., according to a result of comparing the base-emitter or gate-source voltage with the first voltage), a D-flip-flop configured to receive the internal voltage, and output the received internal voltage in response to the temperature sensing signal, and a logic gate configured to logically operate on the received internal voltage and the temperature sensing signal, and output the thermal shutdown signal (e.g., in accordance with a result of logically operating on the received internal voltage and the temperature sensing signal).

In another aspect of the present invention, a light emitting device driving apparatus (e.g., configured to control a light emitting unit including light emitting devices or array(s) thereof connected in series) may include a rectifier configured to rectify an AC signal, and output a ripple current signal (e.g., according to a result of the rectification), a switch unit including a plurality of switches each connected between a first node and a corresponding one of output terminals of the light emitting devices or array(s) thereof, except for a last one of the output terminals, a current controller configured to limit a current between the first node and a ground potential (e.g., to a reference current), and a logic controller configured to adjust the level and/or value of the reference current based on a level of the ripple current signal, and generate one or more control signals (e.g., based on a result of comparing the adjusted reference current and a channel current from the light emitting unit to the first node).

The current controller may include an amplifier including a first input terminal receiving a selection voltage, a second input terminal connected to a second node, and an output terminal; a transistor including a gate connected to the output terminal of the amplifier, and source and drain terminals connected between the first node and the second node; a plurality of resistors connected in series between the second node and a ground potential; and at least one resistive switch connected to opposite ends of at least one of the resistors.

The logic controller may control the at least one resistive switch (e.g., based on a result of comparing the adjusted reference current and the channel current).

The light emitting device driving apparatus may further include an amplifying unit configured to amplify the control signals, and supply the amplified control signals to the switches.

The light emitting device driving apparatus may further include a protection circuit configured to detect a voltage and/or level of the ripple current signal, and generate an enable signal to enable the amplifying unit when the detected voltage and/or level of the ripple current signal is within a predetermined reference voltage range.

In another aspect of the present invention, an illumination system may include a light emitting unit including a plurality of light emitting devices or array(s) thereof connected in series, and a light emitting device driving apparatus configured to control the light emitting unit, wherein the light emitting device driving apparatus includes a rectifier configured to rectify an AC signal, and supply to the light emitting unit a ripple current signal (e.g., according to a result of the rectification), and a sequential driving controller configured to generate a reference current, comparing the reference current with a channel current flowing from the light emitting unit to a first node, and selectively connect one of channel lines connected to respective output terminals of the light emitting devices or array(s) thereof, based on a result of comparing, wherein the sequential driving controller adjusts a level and/or value of the reference current, based on a level of the ripple current signal, and the reference current is a current flowing between the first node and a ground potential.

In accordance with embodiments of the present invention, it may be possible to protect a switch, to achieve an improvement in AC power noise tolerance, to prevent an illumination system from being turned off or flickering in an abnormal situation such as a fire, and to enable the illumination system to emit a normal amount of light when turned on (e.g., after it has been turned off).

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention. In the drawings.

DETAILED DESCRIPTION OF THE INVENTION

Figure 1:
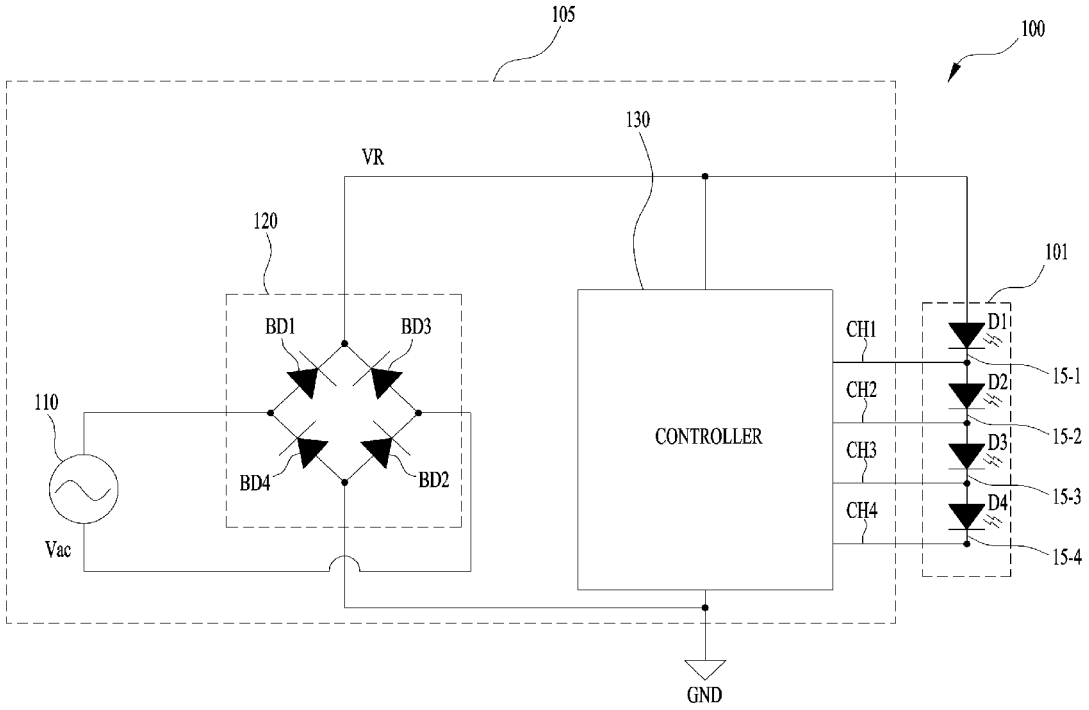
FIG. 1 is a block diagram illustrating an exemplary illumination system according to one or more embodiments.

Hereinafter, embodiments will be described in detail with reference to the annexed drawings for better understanding. In the following description of various embodiments, it will be understood that, when an element such as a layer (film), region, pattern, or structure is referred to as being "on" or "under" another element, it can be directly on or under another element or can be indirectly on or under the other element such that an intervening element is also present. In addition, terms such as "on" or "under" should be understood on the basis of the drawings.

In the drawings, dimensions of layers may be exaggerated, omitted or schematically illustrated for clarity and convenience of the description. In addition, dimensions of constituent elements may not entirely reflect the actual dimensions thereof. The same reference numerals denote the same constituent elements.

FIG. 1 is a block diagram illustrating an exemplary illumination system 100 according to one or more embodiments of the present invention.

Referring to FIG. 1, the illumination system 100 includes a light emitting unit 101 and a light emitting device driving unit 105 configured to control one or more operations of the light emitting unit 101.

The light emitting unit 101 includes a plurality of light emitting devices or array(s) thereof (for example, D1 to D4, connected in series.

For example, the light emitting unit 101 may include first to fourth light emitting devices or array(s) thereof D1 to D4 sequentially connected in series. Although four light emitting devices or array(s) thereof are illustrated in FIG. 1, the number of light emitting devices or array(s) thereof is not limited thereto. Each of the plural light emitting arrays (for example, D1 to D4, may include at least one light emitting diode (LED). When each light emitting device array includes a plurality of LEDs, the plural LEDs may be connected in series, in parallel, or in series and parallel. Thus, each of D1 to D4 may represent a single light emitting device, in which case the series of light emitting devices D1 to D4 represent an array of light emitting devices. Alternatively, each of D1 to D4 may represent an array of light emitting devices (e.g., an n×m array of light emitting devices including n rows and m columns, where n is an integer≥1, and m is an integer≥2). When each of D1 to D4 is an array of light emitting devices, the input to each column of the array is a common input, and the output from each column of the array is a common output.

The light emitting device driving unit 105 controls turning the light emitting devices or array(s) (for example, D1 to D4) on and off. The light emitting device driving unit 105 may include an AC power source 110, a rectifier 120, a controller 130, and channel lines CH1 to CH4.

Figure 8:
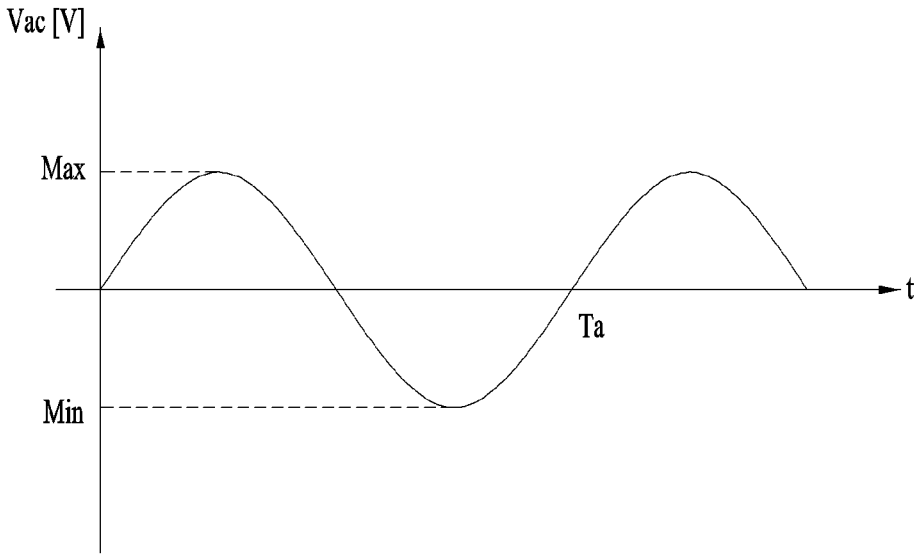
FIG. 8 is a waveform of an exemplary AC signal supplied from an AC power source as illustrated in FIG. 1.

The AC power source 110 supplies an AC signal Vac to the rectifier 120. FIG. 8 is a waveform diagram of the AC signal Vac supplied from the AC power source 110 illustrated in FIG. 1.

Referring to FIG. 8, the AC signal Vac may be a sine or cosine wave having a maximum value of MAX, a minimum value of MIN, and a period Ta. Of course, the AC signal Vac is not limited to the above-described waveform. For example, the AC signal Vac may be an AC voltage (e.g., of 110 to 220 V) having a frequency of 50 to 60 Hz. Of course, the AC signal Vac is not limited to an AC voltage having a frequency of 50 to 60 Hz.

The light emitting device driving unit 105 may further include a fuse connected between the AC power source 110 and the rectifier 120. When an AC signal momentarily has an excessive level, the fuse may be shorted, thereby protecting the light emitting device driving unit 105 from the excessively high AC signal.

The rectifier 120 rectifies the AC signal Vac supplied from the AC power source 110, and outputs a ripple current signal VR generated by or in accordance with the rectification. For example, the ripple current signal VR may be a ripple current or a ripple voltage.

The rectifier 120 may be implemented as a bridge diode circuit including four diodes BD1, BD2, BD3, and BD4 connected as a bridge or plurality of bridges. Of course, the rectifier 120 is not limited to the above-described bridge diode circuit.

Figure 9:
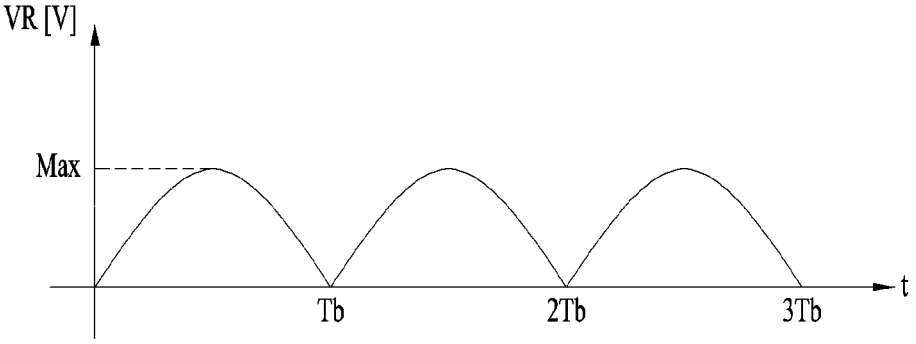
FIG. 9 is a waveform illustrating an exemplary ripple current signal output from a rectifier as illustrated in FIG. 1.

The rectifier 120 may perform full-wave rectification for the AC signal Vac illustrated in FIG. 8. As such, the rectifier 120 may output a ripple current signal VR, which is a full-wave rectified AC signal, an example of which is illustrated in FIG. 9. Hereinafter, the AC signal rectified by the full-wave rectifier 120 will be referred to as a "ripple current signal VR".

The ripple current signal VR output from the rectifier 120 is applied to the light emitting unit 101. For example, the ripple current signal VR may be applied to a first input stage of the series-connected light emitting devices or array(s) thereof (for example, an input stage of the first light emitting device or array D1.

FIG. 9 illustrates an embodiment of the ripple current signal VR output from the rectifier 120 illustrated in FIG. 1. Referring to FIG. 9, the ripple current signal VR may be a sine or cosine wave having a maximum value of MAX, a minimum value of 0, and a period Tb. Of course, the ripple current signal VR is not limited to the above-described waveform. The period Tb of the ripple current signal VR may be a half the period Ta of the AC signal Vac (i.e., Tb=Ta/2).

The controller 130 controls turning the series-connected light emitting devices or array(s) (for example, D1 to D4) of the light emitting unit 101 on and off, based on the ripple current signal VR supplied from the rectifier 120.

The channel lines CH1 to CH4 may be connected between respective output terminals 15-1 to 15-4 of the light emitting devices or array(s) D1 to D4 and the controller 130. For example, each of the channel lines CH1 to CH4 may be connected to a corresponding one of the output terminals 15-1 to 15-4 of the light emitting devices or array(s) D1 to D4. Each of the channel lines CH1 to CH4 may establish a current path between the corresponding one of the output terminals 15-1 to 15-4 of the light emitting devices or array(s) D1 to D4 and the controller 130.

When each of the light emitting devices or arrays D1 to D4 includes a plurality of LEDs connected in series, the output terminal of the light emitting device or array D1, D2, D3 or D4 may be an output terminal of a last one of the LEDs connected in series.

Figure 2:
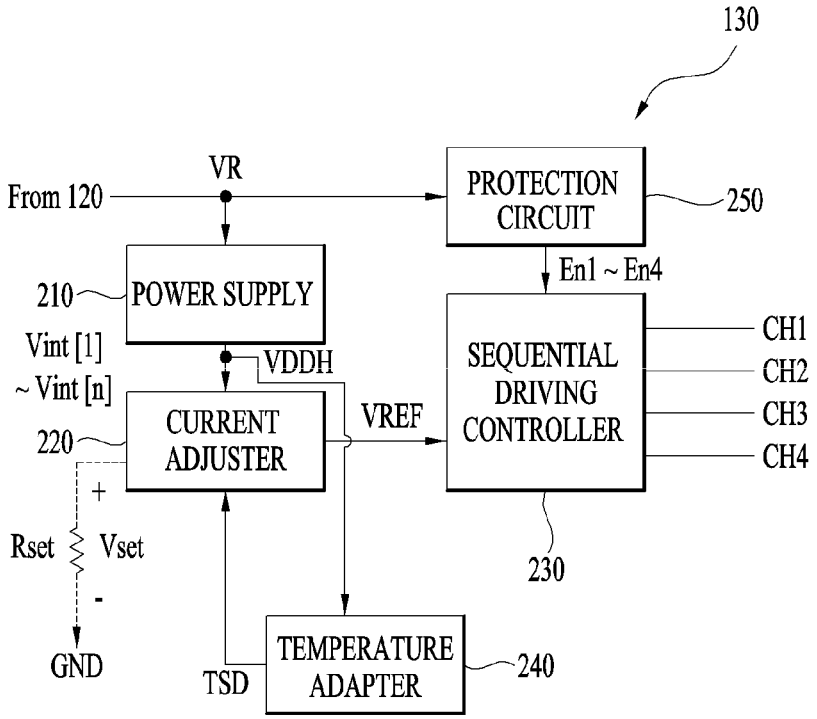
FIG. 2 is a block diagram illustrating one or more embodiments of an exemplary controller as illustrated in FIG. 1.

FIG. 2 is a block diagram illustrating one or more embodiments of the exemplary controller 130 illustrated in FIG. 1. Referring to FIG. 2, the controller 130 may include a power supply 210, a current adjuster 220, a sequential driving controller 230, a temperature adapter 240, and a protection circuit 250.

The power supply 210 receives the ripple current signal VR and, as such, generates an internal voltage VDDH and selective voltages Vint[1] to Vint[n] (n being a natural number greater than 1 [i.e., n>1]). For example, the power supply 210 may receive the ripple current signal VR and may generate a constant internal voltage VDDH based on the received ripple current signal VR. Using the internal voltage VDDH, the power supply 210 may generate a plurality of selective voltages Vint[1] to Vint[n] having different levels (n being a natural number greater than 1 [i.e., n>1]).

Figure 3:
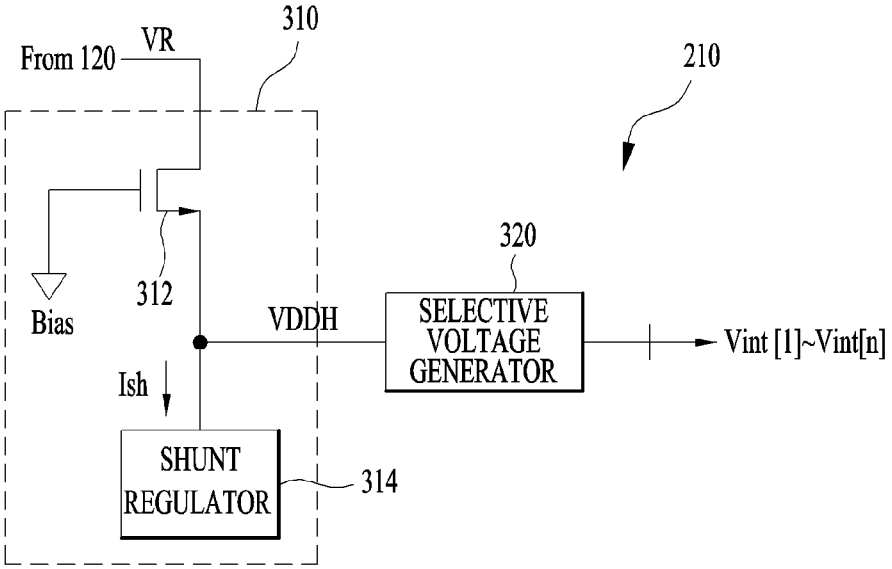
FIG. 3 is a diagram illustrating one or more embodiments of an exemplary power supply as illustrated in FIG. 2.

FIG. 3 illustrates an exemplary embodiment of the power supply 210 illustrated in FIG. 2. Referring to FIG. 3, the power supply 210 may include a constant voltage generator 310 and a selective voltage generator 330.

The constant voltage generator 310 may generate the internal voltage VDDH based on the ripple current signal VR. In one or more embodiments, the internal voltage VDDH is a constant voltage. For example, the constant voltage generator 320 may include a transistor 312 (e.g., a MOS or NMOS transistor) having a source, a gate to which a bias voltage is applied, and a drain, to which the ripple current signal VR is applied, and a shunt regulator 314 connected to the source of the transistor 312.

The voltage across the transistor 312 may be determined by a current Ish flowing through the shunt regulator 314. The shunt regulator 314 may adjust the current Ish such that the voltage difference between the ripple current signal VR and the source-drain voltage of the transistor 312 is equal to the internal voltage VDDH.

The selective voltage generator 330 may generate a plurality of selective voltages Vint[1] to Vint[n] having different levels (n being a natural number greater than 1 [i.e., n>1]), based on the internal voltage VDDH generated by the constant voltage generator 320.

Figure 4:
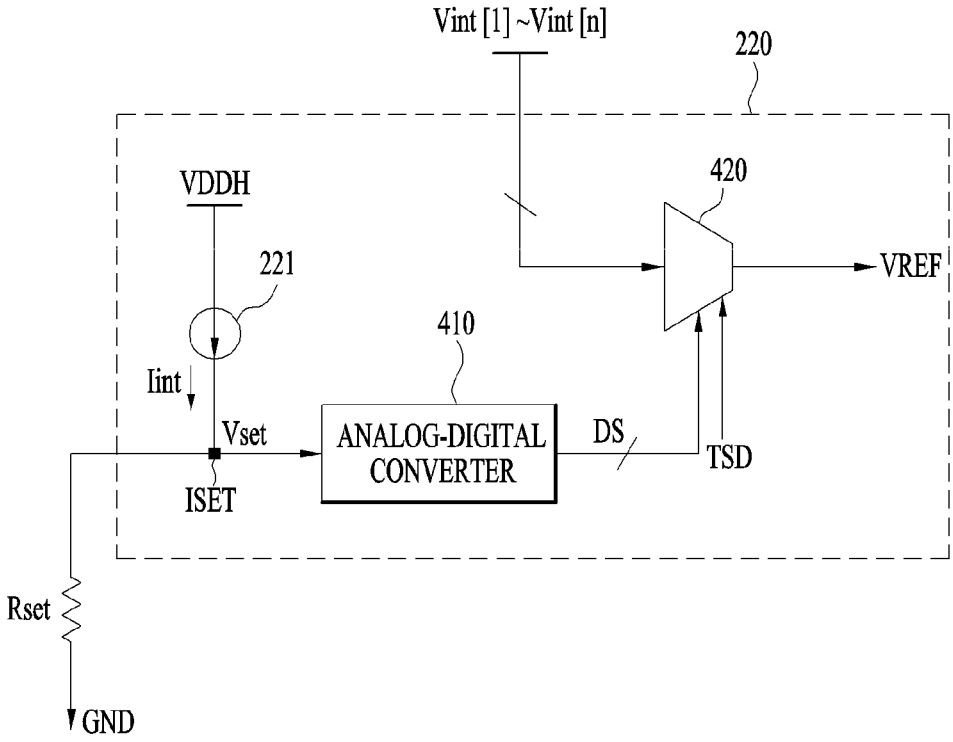
FIG. 4 is a diagram illustrating a configuration of an exemplary current adjuster as illustrated in FIG. 2.

FIG. 4 illustrates an exemplary configuration of the current adjuster 220 illustrated in FIG. 2. The current adjuster 220 may adjust the intensity of current flowing through the light emitting unit 101.

The current adjuster 220 generates a setting voltage Vset, converts the analog setting voltage Vset to a digital value DS, selects one of the selective voltages Vint[1] to Vint[n] (n being a natural number greater than 1 [i.e., n>1]) based on the digital value DS, and outputs a selection voltage VREF (e.g., according to the selection). In this case, the setting voltage Vset may be based on a resistance of an external resistor Rset.

Alternatively, the current adjuster 220 may output the selection voltage VREF based on or in response to thermal shutdown signal TSD from the temperature adapter, which will be described later. For example, when the thermal shutdown signal TSD has a first level (for example, a high binary logic level), the current adjuster 220 may output as the selection voltage VREF a lowest one of the selective voltages Vint[1] to Vint[n] (n being a natural number greater than 1 [i.e., n>1]). On the other hand, when the thermal shutdown signal TSD has a second level (for example, a low binary logic level), the current adjuster 220 may select one of the selective voltages Vint[1] to Vint[n] (n being a natural number greater than 1 [i.e., n>1]) as the selection voltage VREF based on the digital value DS.

The current adjuster 220 may include an external resistor connection terminal ISET, an internal current source 221, an analog-digital converter 410, and a selector 420. An external resistor Rset may be connected to the external resistor connection terminal ISET.

The internal current source 221 supplies an internal current Iint to the external resistor connection terminal ISET. The internal current source 221 may be connected at one end to the external resistor connection terminal ISET. The internal voltage VDDH from the power supply 210 may be applied to another end of the internal current source 221 (e.g., one or more inputs or power supply-receiving terminals of the internal current source 221).

The setting voltage Vset may be a voltage across the external resistor Rset or a voltage at the external resistor connection terminal ISET. The setting voltage Vset may be determined by the external resistor Rset. For example, the setting voltage Vset may be equal to the product of the resistance of the external resistor Rset and the internal current Iint (Vset=Iint×Rset).

The analog-digital converter 410 converts the analog setting voltage Vset to a digital value DS.

The selector 420 selects one of the selective voltages Vint[1] to Vint[n] from the power supply 210 (n being a natural number greater than 1 [i.e., n>1]) based on the digital value DS, and outputs a selection voltage VREF according to the selection.

Alternatively, the selector 420 may select one of the selective voltages Vint[1] to Vint[n] (n being a natural number greater than 1 [i.e., n>1]) as the selection voltage VREF according to the thermal shutdown signal TSD. For example, when the thermal shutdown signal TSD has a first logic level (for example, a high binary logic level), the selector 420 may output, as the selection voltage VREF, the lowest one of the plural selective voltages Vint[1] to Vint[n] (n being a natural number greater than 1 [i.e., n>1]). Alternatively, when the thermal shutdown signal TSD has a second logic level (for example, a low binary logic level), the selector 420 may select one of the plural selective voltages Vint[1] to Vint[n] (n being a natural number greater than 1 [i.e., n>1]) as the selection voltage VREF according to the digital value DS.

Based on the selection voltage VREF, an intensity of current flowing through the light emitting unit 101 may be determined and/or controlled.

Since the external resistor Rest is used only to select the selection voltage VREF in embodiment(s) that include the current adjuster 220 of FIG. 4, there is no influence on the selection voltage VREF even when AC power noise (for example, fluctuation noise) flows into the external resistor Rset. In such embodiment(s), it may be possible to adjust the current flowing through the light emitting unit 101 without any influence of noise (for example, fluctuation noise) entering through the external resistor Rset.

In brief, in one or more embodiments of the present invention, the selection voltage VREF is determined by converting the voltage across the external resistor Rset into a digital value using the analog-digital converter 410, and then selecting one of the selective voltages Vint[1] to Vint[n] (n being a natural number greater than 1 [i.e., n>1]) based on the digital value. As such, it may be possible to adjust the current flowing through the light emitting unit 101 without any influence of AC power noise.

The selection voltage VREF may also be selected based on or in response to the thermal shutdown signal TSD, and an intensity of current flowing through the light emitting unit 101 can be adjusted as a result. In this case, it may be possible to control a brightness of the light emitting unit 101 in accordance with temperature variation(s) of the illumination system 100.

The sequential driving controller 230 (e.g., as illustrated in FIG. 2) may sequentially drive the light emitting devices or array(s) thereof D1 to D4 of the light emitting unit 101 based on the voltage and/or level of the ripple current signal VR. For example, the sequential driving controller 230 may allow current from the light emitting unit 101 to flow to one of the first to fourth channels CH1 to CH4, based on the voltage and/or level of the ripple current signal VR.

Figure 5:
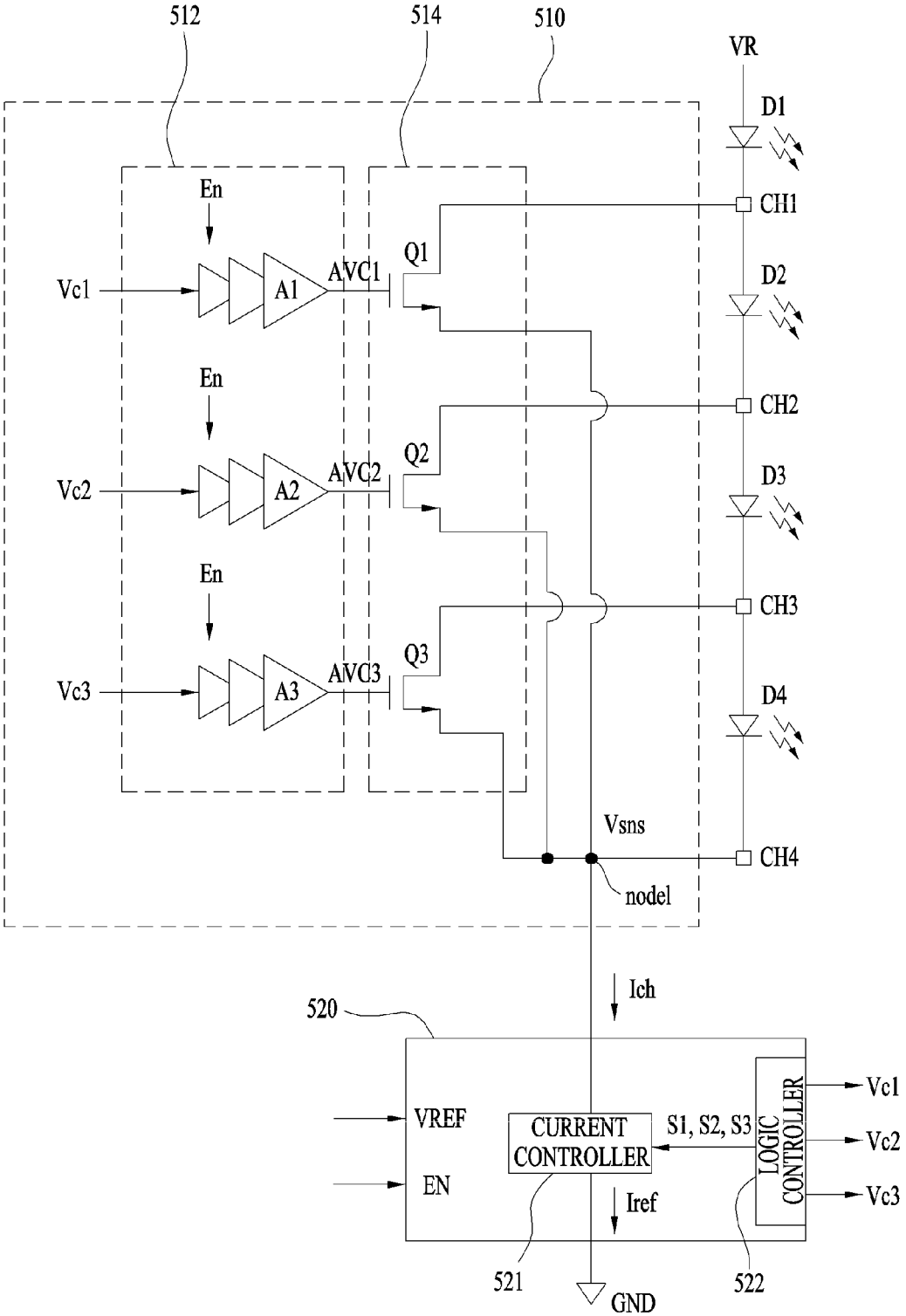
FIG. 5 is a diagram illustrating a configuration of an exemplary sequential driving controller as illustrated in FIG. 2.

FIG. 5 illustrates an exemplary configuration of the sequential driving controller 230 as illustrated in FIG. 2. Referring to FIG. 5, the sequential driving controller 230 may connect a selected one of the channel lines CH1 to CH4 to a first node (e.g., node1). The channel lines CH1 to CH4 are connected to respective output terminals of the light emitting devices or array(s) thereof D1 to D4.

The sequential driving controller 230 may adjust a level and/or value of a reference current Iref based on a voltage and/or level of the ripple current signal VR, and may selectively connect one of the channel lines to the first node node1 based on a comparison between the level-adjusted reference current and a channel current Ich at the first node node1.

The sequential driving controller 230 may include a switch driver 510 and switching controller 520.

The switch driver 510 may include an amplifying unit 512 including a plurality of amplifiers (for example, A1 to A3) and a switch unit 514 including a plurality of switches (for example, Q1 to Q3).

The amplifying unit 512 (e.g., each of the amplifiers A1 to A3 therein) may be enabled in response to an enable signal En. The amplifying unit 512 amplifies control signals (for example, VC1 to VC3) and outputs the amplified control signals (for example, AVC1 to AVC3). The amplifying unit 512 may amplify the control signals (for example, VC1 to VC3) to a level suitable to drive the switches of the switch unit 514 (for example, Q1 to Q3).

Each of the amplifiers A1 to A3 may amplify a corresponding one of the control signals VC1 to VC3, and may output the amplified control signal. Each of the amplifiers A1 to A3 may be or comprise a differential amplifier or an operational amplifier.

The switch unit 514 connects one of the channel lines CH1 to CH3 to the first node node1, except for the last channel line CH4, based on the amplified control signals AVC1 to AVC3. Each of the switches Q1 to Q3 is between and/or connect to a corresponding one of the remaining channel lines CH1 to CH3, except for the last channel line CH4. Each of the switches Q1 to Q3 may be implemented as a transistor (e.g., a MOS or NMOS transistor). Although each switch is implemented as a field effect transistor (for example, an NMOS transistor) in the case of FIG. 5, the switches are not limited thereto. Each of the switches Q1 to Q3 may include a gate configured to receive a corresponding one of the amplified control signals AVC1 to AVC3, a drain connected to a corresponding one of the channel lines CH1 to CH3, and a source connected to the first node node1.

The first node node1 may be a node to which each of the switches Q1 to Q3 and the last one of the output terminals of the light emitting devices or array(s) thereof D1 to D4 (e.g., CH4) are connected.

The switches Q1 to Q3 may be turned on or off based on or in response to respective amplified control signals AVC1 to AVC3.

The switching controller 520 is connected between the ground potential GND and the first node node1. That is, the switching controller 520 may be connected between the ground potential GND and the last channel CH4.

The switching controller 520 may generate the control signals VC1 to VC3 that turn on or off the switches Q1 to Q3, respectively, based on or in response to the voltage and/or level of the ripple current signal VR. For example, the switching controller 520 may turn off all of the switches Q1 to Q3 to float the channel lines CH1 to CH3 with respect to the first node node1 and thereby operably connect only the last channel CH4 to the first node node1. In addition, the switching controller 520 may turn on one of the switches Q1 to Q3 to connect a corresponding one of the channel lines CH1 to CH3 to the first node node1. The channel line connected to the first node node1 may establish a current path between the switching controller 520 and the first node node1.

The switching controller 520 may include a current controller 521 to generate a reference current Iref based on or in response to the selection voltage VREF and switching control signals S1 to S3, and a logic controller 522 to generate control signals Vc1 to Vc3 and switching control signals S1 to S3 based on or in response to the voltage and/or level of the ripple current signal VR.

The reference current Iref may be or comprise a current between the first node node1 and the ground potential. More particularly, the reference current Iref may be a current at a node between the current controller 521 and the ground potential. The level and/or value of the reference current Iref may be adjusted by the logic controller 522, as described herein. The logic controller 522 may select as the reference current one of first to fourth reference currents (for example, Ir1 to Ir4; see FIG. 10) having different levels.

Figure 6:
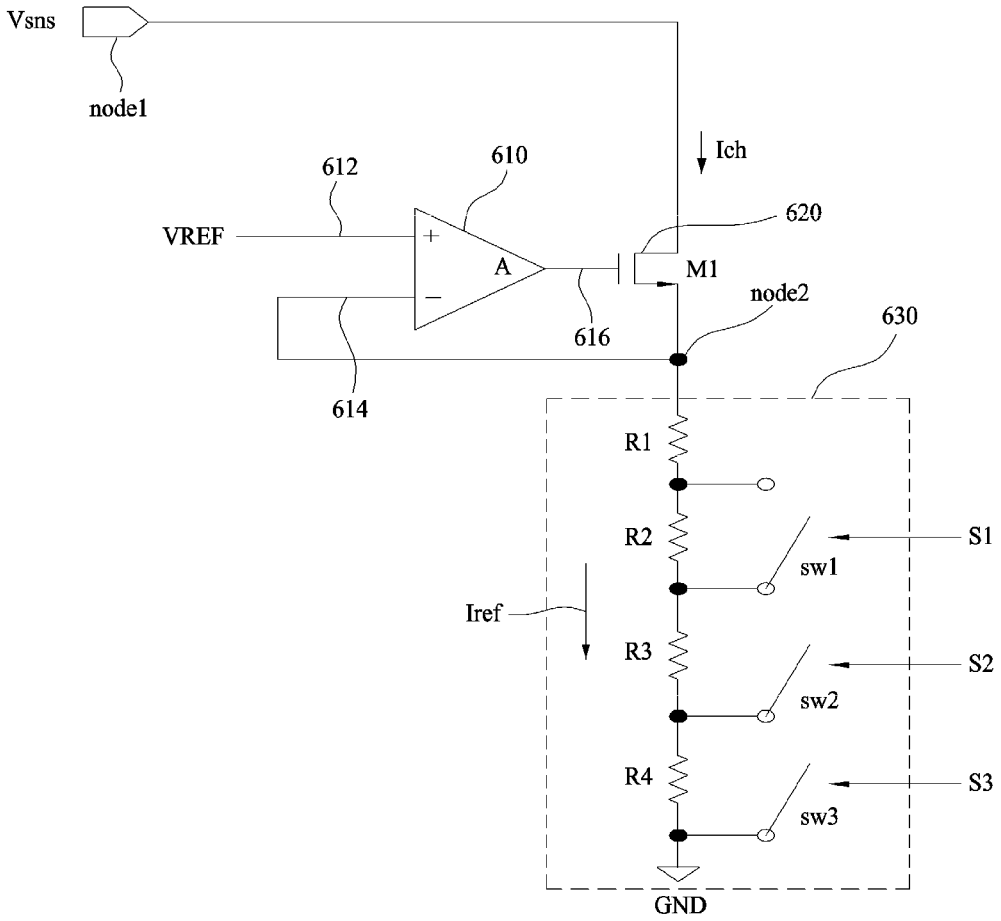
FIG. 6 is a diagram illustrating an embodiment of an exemplary current controller as illustrated in FIG. 5.

FIG. 6 illustrates an embodiment of the current controller 521 as illustrated in FIG. 5. Referring to FIG. 6, the current controller 521 may include an amplifier 610, a transistor 620, and a variable resistor unit 630.

The amplifier 610 may include a first input terminal 612 configured to receive the selection voltage VREF, a second input terminal 614 connected to a second node node2, and an output terminal 616.

The transistor 620 may include a drain connected to the first node node1, a gate connected to the output terminal 616 of the amplifier 610, and a source connected to the second node node2.

The variable resistor unit 630 is connected between the second node node2 and the ground potential GND. The resistance of the variable resistor unit 630 depends on the voltage and/or level of the ripple current signal VR. The variable resistor unit 630 may include a plurality of resistors R1 to R4 connected in series between the second node node2 and the ground potential GND, and resistive switches (for example, sw1 to sw3) connected between opposite ends of at least one of the plural resistors R1 to R4. The resistive switches sw1 to sw3 may be turned on or off based on or in response to the ripple current voltage VR. Turning on or turning off different combinations of the resistive switches sw1 to sw3 results in a different resistance of the variable resistor unit 630. The resistance of the variable resistor unit 630 may be a combined resistance of the resistors R1 to R4 connected in series between the second node node2 and the ground potential GND. In one example, the resistances of the resistors R1 to R4 may be equal to each other. That is, all of the resistors R1 to R4 may have a resistance R. Of course, the present invention is not limited to such a condition.

When the voltage at the first node node1 (namely, a first node voltage Vsns) is applied to the drain of the transistor 620, a channel current Ich flows from the drain to the source in the transistor 620. The voltage at the second node node2 may be equal to the selection voltage VREF in accordance with a feed-back function of the amplifier 610. The reference current Iref generated by the current controller 521 may be equal to a value obtained by the voltage at the second node node2 by the resistance of the variable resistor 630.

For example, the logic controller 522 may generate the control signals S1 to S3, which turn on at least one of the first to third switches sw1 to sw3. In accordance with the control signals S1 to S3, the resistance of the variable resistor unit 630 may be R, 2R, 3R or 4R (see, e.g., FIG. 10).

Figure 10:
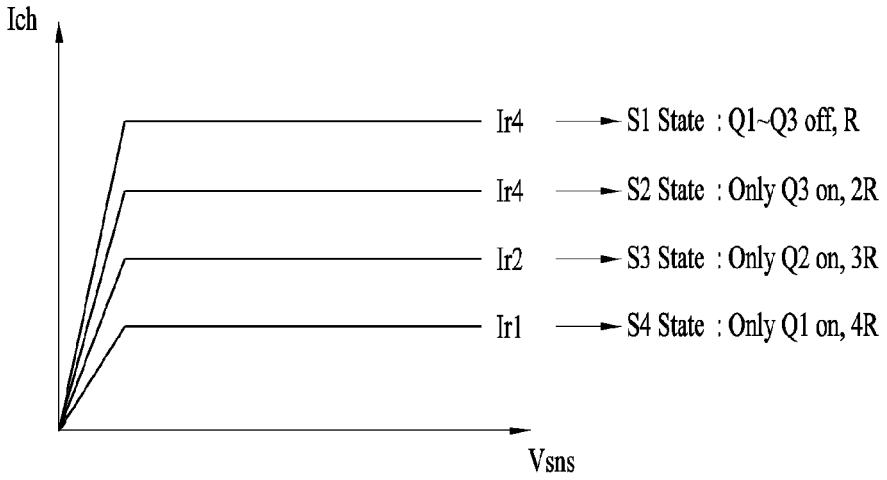
FIG. 10 is a graph depicting examples of a reference current in accordance with one or more embodiments of the present invention.

FIG. 10 illustrates examples of the reference current Iref. Referring to FIG. 10, when the resistance of the variable resistor unit 630 is R, the reference current Iref adjusted by the current controller 521 may be a fourth reference current Ir4 (Ir4=VREF/R). When the resistance of the variable resistor unit 630 is 2R, the reference current Iref adjusted by the current controller 521 may be a third reference current Ir3 (Ir3=VREF/2R). When the resistance of the variable resistor unit 630 is 3R, the reference current Iref adjusted by the current controller 521 may be a second reference current Ir2 (Ir2=VREF/3R). When the resistance of the variable resistor unit 630 is 4R, the reference current Iref adjusted by the current controller 521 may be a first reference current Ir1 (Ir1=VREF/4R).

Figure 13:
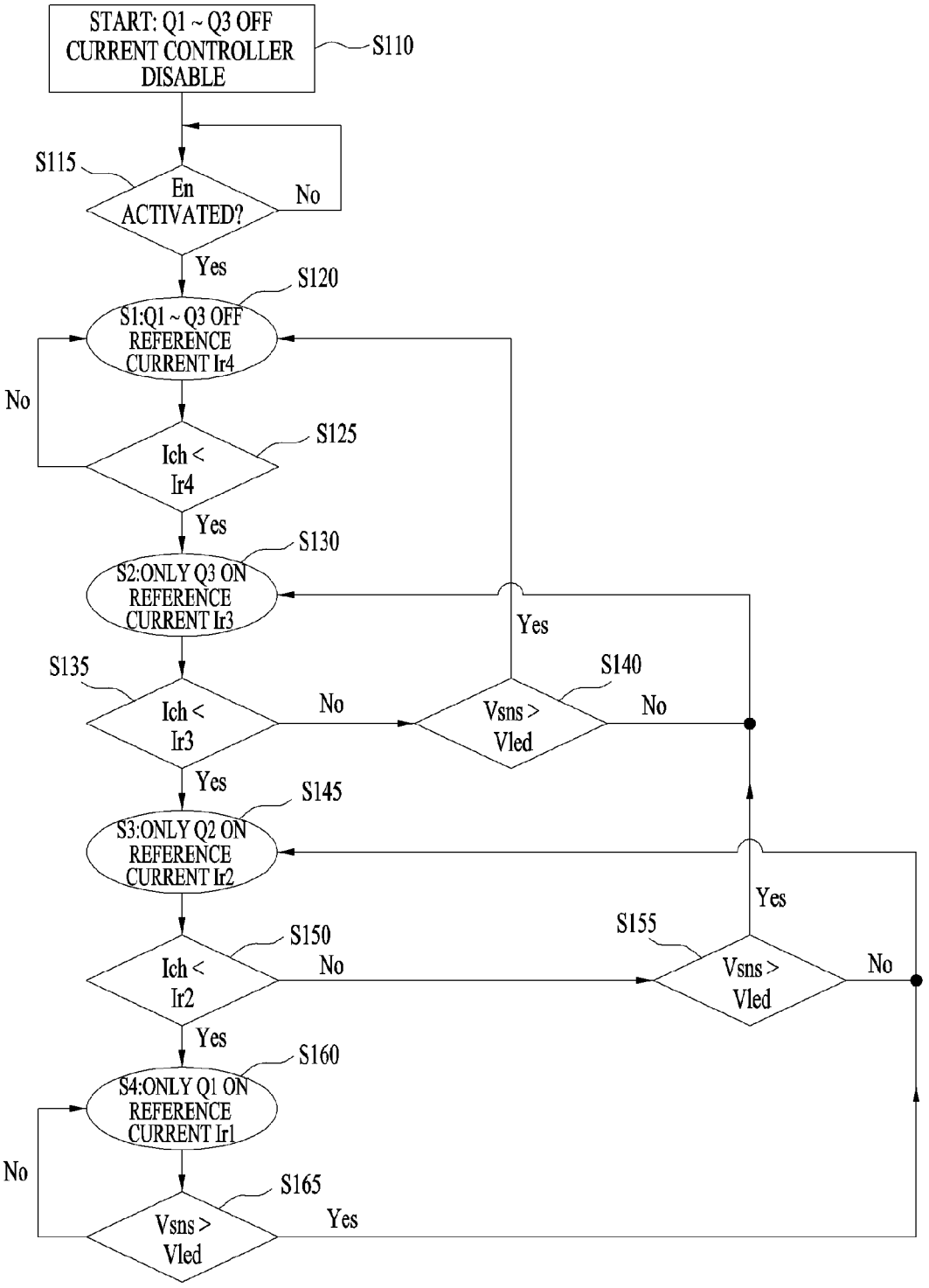
FIG. 13 is a flow chart illustrating one or more logic operations of the exemplary sequential driving controller.

FIG. 13 is a flow chart illustrating exemplary logic operations of the sequential driving controller 230.

Referring to FIG. 13, in a start state 5110, which is a state before the enable signal En is applied to the sequential driving controller 230, the amplifiers A1 to A3 of the switch driver 510 and the current controller 521 are disabled. When the enable signal En is applied from the protection circuit 240 to the sequential driving controller 230 (S115), the sequential driving controller 230 enters a first state S1 (S120).

In the first state S1, the logic controller 522 generates control signals Vc1 to Vc3 to turn off all of the first to third switches Q1 to Q3. In addition, the current controller 521 sets the reference current Iref to the fourth reference current Ir4.

For example, in the first state S1, the logic controller 522 may generate first to third control signals Vc1 to Vc3 having a second voltage level (for example, a low binary logic level), and the current controller 521 may set the fourth reference current Ir4 as the reference current Iref based on the switching control signals S1 to S3 input from the logic controller 522.

When the current Ich supplied to the current controller 521 in the first state S1 is greater than or equal to the fourth reference current Ir4, the sequential driving controller 230 and/or the logic operation state thereof is maintained at the first state S1. On the other hand, when the current Ich supplied to the current controller 521 in the first state S1 is smaller than the first reference current Ir4 (Ich<Ir4), the sequential driving controller 230 and/or the logic operation state thereof changes from the first state S1 to a second state S2 (S125).

In the second state S2, the logic controller 522 generates control signals Vc1 to Vc3 to turn on only the third switch Q3. In addition, the current controller 521 sets the reference current Iref to the third reference current Ir3. For example, in the second state S2, the logic controller 522 may generate first and second control signals Vc1 and Vc2 having a second voltage level (for example, a low binary logic level) and a third control signal Vc3 having a first voltage level (for example, a high binary logic level).

When the current Ich supplied to the current controller 521 in the second state S2 is greater than or equal to the third reference current Ir3 (S135), and the voltage Vsns at the first node node1 is lower than or equal to a unit reference voltage Vled, the sequential driving controller 230 and/or the logic operation state thereof is maintained at the second state S2 (S140). On the other hand, when the voltage Vsns at the first node node1 is higher than the unit reference voltage Vled, the sequential driving controller 230 and/or the logic operation state thereof changes from the second state S2 to the first state S1 (S140).

When the current Ich supplied to the current controller 521 in the second state S2 is smaller than the third reference current Ir3, the sequential driving controller 230 and/or the logic operation state thereof changes from the second state S2 to a third state S3 (5145).

In the third state S3, the logic controller 522 generates control signals Vc1 to Vc3 to turn on the second switch Q2 and to turn off the first and third switches Q1 and Q3. In addition, the current controller 521 sets the reference current Iref to the second reference current Ir2. For example, in the third state S3, the logic controller 522 may generate a second control signals Vc2 having a first voltage level (for example, a high binary logic level) and first and third control signals Vc1 and Vc3 having a second voltage level (for example, a low binary logic level).

When the current Ich supplied to the current controller 521 in the third state S3 is greater than or equal to the second reference current Ir2, and the voltage Vsns at the first node node1 is lower than or equal to the unit reference voltage Vled, the sequential driving controller 230 and/or the logic operation state thereof is maintained at the third state S3. On the other hand, when the voltage Vsns at the first node node1 is higher than the unit reference voltage Vled, the sequential driving controller 230 and/or the logic operation state thereof changes from the third state S3 to the second state S2.

However, when the current Ich supplied to the current controller 521 in the third state S3 is smaller than the second reference current Ir2, the sequential driving controller 230 and/or the logic operation state thereof changes from the third state S3 to the fourth state S4. In the fourth state S4, the logic controller 522 generates control signals Vc1 to Vc3 to turn on the first switch Q1 and to turn off the second and third switches Q2 and Q3. In addition, the current controller 521 sets the reference current Iref to the first reference current Ir1.

When the voltage Vsns at the first node node1 in the fourth state S4 is higher than the unit reference voltage Vled, the sequential driving controller 230 and/or the logic operation state thereof changes from the fourth state S4 to the third state S3. However, when the voltage Vsns at the first node node1 in the fourth state S4 is equal to or lower than the unit reference voltage Vled, the sequential driving controller 230 is maintained at the fourth state S4.

Figure 12:
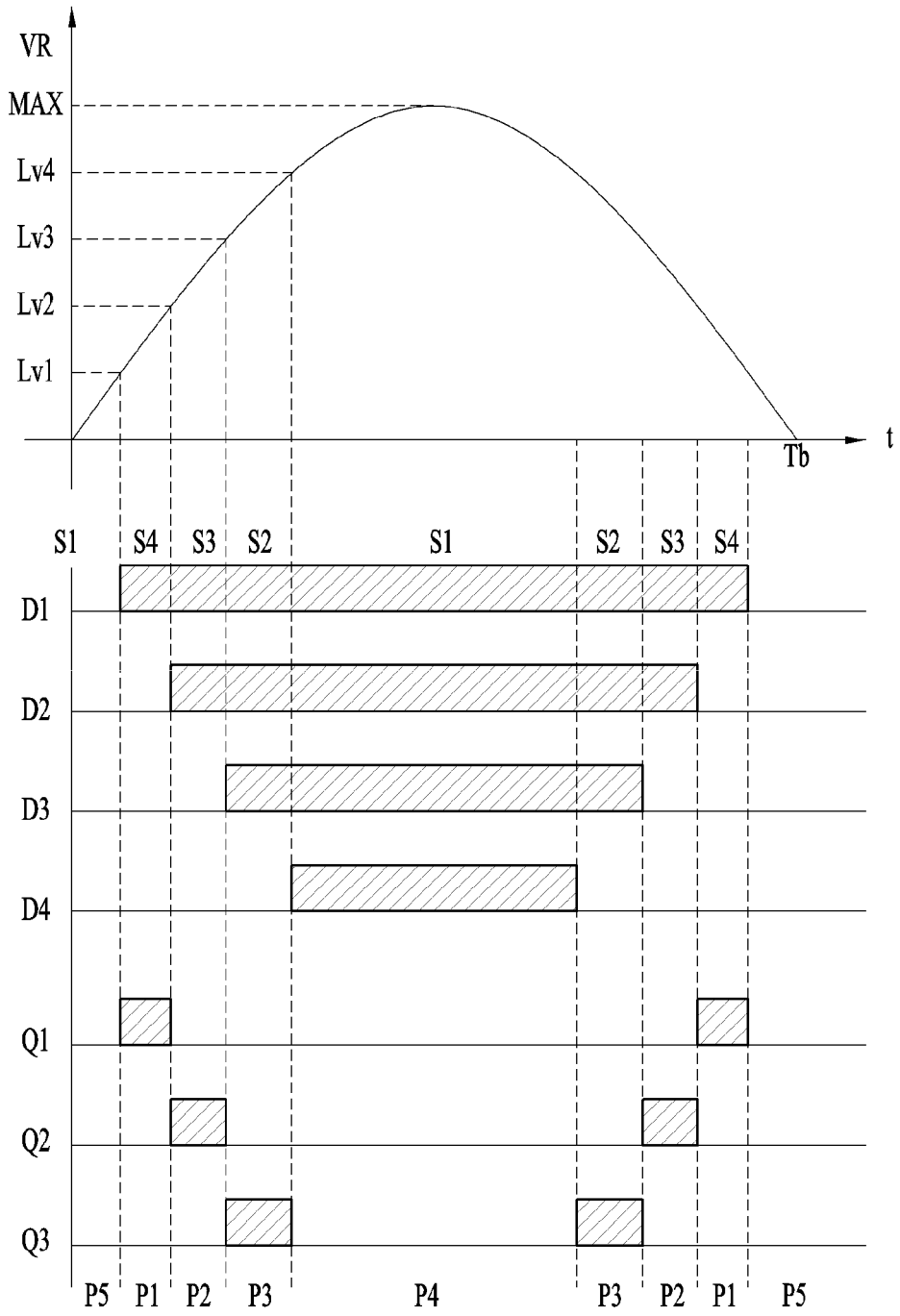
FIG. 12 is a graph depicting one or more logic operations of an exemplary sequential driving controller in accordance with the level of an exemplary ripple current signal.

FIG. 12 illustrates a logic operation state S of the sequential driving controller 230 according to the voltage or level of the ripple current signal VR.

Referring to FIG. 12, a first reference level LV1 may be a voltage capable of driving one light emitting device or array (for example, D1, in which case LV1=VF1). A second reference level LV2 may be a voltage capable of driving two light emitting devices or array(s) thereof (for example, D1 and D2, in which case LV2=VF1+VF2). A third reference level LV3 may be a voltage capable of driving three light emitting devices or array(s) thereof (for example, D1, D2, and D3, in which case LV3=VF1+VF2+VF3). A fourth reference level LV4 may be a voltage capable of driving four light emitting devices or array(s) thereof (for example, D1, D2, D3, and D4, in which case LV4=VF1+VF2+VF3+VF4). VF1 may be a drive voltage of the first light emitting device array D1, VF2 may be a drive voltage of the second light emitting device array D2, VF3 may be a drive voltage of the third light emitting device array D3, and VF4 may be a drive voltage of the fourth light emitting device array D4.

Referring to FIG. 12, in a first period P1 in which the level or voltage of the ripple current signal VR is equal to or higher than the first reference level LV1, but lower than the second reference level LV2, the sequential driving controller 230 and/or the logic operation state thereof may enter the fourth state S4. When the sequential driving controller 230 and/or the logic operation state thereof is in the fourth state S4, only the first channel line CH1 may be connected to the fourth channel line CH4, and the remaining channel lines CH2 and CH3 may be electrically disconnected from the fourth channel line CH4. When only the first channel line CH1 is connected to the fourth channel line CH4, a first current path may be established by the first light emitting device array D1, first switch Q1, current controller 521, and ground potential GND. In this state, only the first light emitting device array D1 emits light.

In the fourth state S4, the current Ich flowing between the first node node1 and the ground potential GND may be the first reference current Ir1. The current Ich is controlled by the current controller 521.

In a second period P2 in which the level or voltage of the ripple current signal VR is equal to or higher than the second reference level LV2, but lower than the third reference level LV3, the sequential driving controller 230 and/or the logic operation state thereof may enter the third state S3. When the sequential driving controller 230 and/or the logic operation state thereof is in the third state S3, only the second channel line CH2 may be connected to the fourth channel line CH4, and the remaining channel lines CH1 and CH3, except for the second channel line CH2, may be electrically disconnected from the fourth channel line CH4. When only the second channel line CH2 is connected to the fourth channel line CH4, a second current path may be established by the first and second light emitting devices or array(s) thereof D1 and D2, second switch Q2, current controller 521, and ground potential GND. In this state, only the first and second light emitting devices or array(s) thereof D1 and D2 emit light.

When the sequential driving controller 230 and/or the logic operation state thereof is in the third state S3, the current Ich flowing between the first node node1 and the ground potential GND may be the second reference current Ir2. As in the second state S2, the current Ich is controlled by the current controller 521.

In a third period P3 in which the level or voltage of the ripple current signal VR is equal to or higher than the third reference level LV3, but lower than the fourth reference level LV4, the sequential driving controller 230 and/or the logic operation state thereof may enter the second state S2. When the sequential driving controller 230 and/or the logic operation state thereof is in the second state S2, only the third channel line CH3 may be connected to the fourth channel line CH4, and the remaining channel lines CH1 and CH2 may be electrically disconnected from the fourth channel line CH4. When only the third channel line CH3 is connected to the fourth channel line CH4, a third current path may be established by the first to third light emitting devices or array(s) thereof D1 to D3, third switch Q3, current controller 521, and ground potential GND. In this state, the first to third light emitting devices or array(s) thereof D1 to D3 emit light.

When the sequential driving controller 230 and/or the logic operation state thereof is in the second state S2, the current Ich flowing between the first node node1 and the ground potential GND may be the third reference current Ir3.

In a fourth period P4 in which the level or voltage of the ripple current signal VR is equal to or higher than the fourth reference level LV4, the sequential driving controller 230 and/or the logic operation state thereof may be in the first state S1. When the sequential driving controller 230 and/or the logic operation state thereof is in the first state S1, the first to third channel lines CH1 to CH3 may be electrically disconnected from the fourth channel line CH4. In this state, a fourth current path may be established by the first to fourth light emitting devices or array(s) thereof D1 to D4, current controller 521, and ground potential GND. In this state, all of the first to fourth light emitting devices or array(s) thereof D1 to D4 emit light.

When the sequential driving controller 230 and/or the logic operation state thereof is in the first state S1, the current Ich flowing between the first node node1 and the ground potential GND may be the fourth reference current Ir4.

In a fifth period P5 in which the level of the ripple current signal VR is lower than the first reference level LV1, the sequential driving controller 230 and/or the logic operation state thereof may be in the fourth state S4. In the fifth period P5, only the first channel line CH1 may be connected to the fourth channel line CH4, and the remaining channel lines CH2 and CH3 may be electrically disconnected from the fourth channel line CH4.

Although the first current path may be established by the first light emitting device or array D1, first switch Q1, current controller 521, and the ground potential GND in the fifth period P5, the first light emitting device array D1 cannot be turned on because the level of the ripple current signal VR is lower than the first reference level LV1. As such, none of the first to fourth light emitting devices or array(s) thereof D1 to D4 can emit light.

Hereinafter, a logic operation state S of the switching controller 520 will be described with reference to FIGS. 12 and 13. The following description will be given for the case in which the voltage and/or level of the ripple current signal VR rises from a minimum level Min to a maximum level Max.

When the voltage and/or level of the ripple current signal VR is lower than the first reference level LV1, and the enable signal En is activated, the switching controller 520 and/or the logic operation state thereof enters the first state S1. Since the voltage and/or level of the ripple current signal VR is lower than the first reference level LV1, the current Ich flowing through the current controller 521 is zero. In accordance with FIG. 13, the switching controller 520 and/or the logic operation state thereof changes from the first state S1 to the fourth state S4 (S1→S2→S3→S4).

In the fourth state S4, the first light emitting device array D1 may be connected to the current controller 521 via the first switch Q1. However, the first light emitting device array D1 is turned off because the voltage and/or level of the ripple current signal VR is lower than the first reference level LV1. Accordingly, all light emitting devices and/or array(s) thereof D1 to D4 may be in an OFF state.

When the voltage and/or level of the ripple current signal VR becomes equal to or higher than the first reference level LV1, but lower than the second reference level LV2, the switching controller 520 may be maintained in the fourth state S4 because the voltage Vsns at the first node node1 is lower than the unit reference voltage Vled. In this case, the first light emitting device array D1 may be turned on because the voltage and/or level of the ripple current signal VR is higher than the first reference level LV1. The current flowing through the first light emitting device array D1 is Ir1 (e.g., by the current controller 521).

When the voltage and/or level of the ripple current signal VR increases to the second reference level LV2 or higher, but lower than the third reference level LV3, the switching controller 520 may change from the fourth state S4 to the third state S3 because the voltage Vsns at the first node node1 is higher than the unit reference voltage Vled. In the third state S3, the switching controller 520 may generate control signals Vc1 to Vc3 to turn on only the second switch Q2. Accordingly, the first and second light emitting devices or array(s) thereof D1 and D2 may be connected to the current controller 521 via the second switch Q2. In this case, the first and second light emitting devices or array(s) thereof D1 and D2 may be turned on because the voltage and/or level of the ripple current signal VR is higher than the second reference level LV2.

Since the voltage Vsns at the first node node1 becomes lower than the unit reference voltage Vled in accordance with the first and second light emitting devices or array(s) thereof D1 and D2 turning on, the switching controller 520 and/or the logic operation state thereof may be maintained in the third state S3. In this case, the current flowing through the first and second light emitting devices or array(s) thereof D1 and D2 is the second reference current Ir2 (e.g., by the current controller 521).

When the voltage and/or level of the ripple current signal VR becomes equal to or higher than the third reference level LV3, but lower than the fourth reference level LV4, the switching controller 520 and/or the logic operation state thereof may change from the third state S3 to the second state S2 because the voltage Vsns at the first node node1 becomes higher than the unit reference voltage Vled. In the second state S2, the switching controller 520 may generate control signals Vc1 to Vc3 to turn on only the third switch Q3. Accordingly, the first to third light emitting devices or array(s) thereof D1 to D3 may be connected to the current controller 521 via the third switch Q3 and, as such, may be turned on. Since the voltage Vsns at the first node node1 becomes lower than the unit reference voltage Vled in accordance with turning-on of the first to third light emitting devices or array(s) thereof D1 to D3, the switching controller 520 and/or the logic operation state thereof may be maintained at the second state S2. In this case, the current flowing through the first to third light emitting devices or array(s) thereof D1 to D3 is the third reference current Ir3 (e.g., by the current controller 521).

When the voltage and/or level of the ripple current signal VR becomes higher than the fourth reference level LV4, the switching controller 520 and/or the logic operation state thereof may change from the second state S2 to the first state S1 because the voltage Vsns at the first node node1 becomes higher than the unit reference voltage Vled. In the first state S1, the switching controller 520 may generate control signals Vc1 to Vc3 to turn off all of the first to third switches. In this case, the first to fourth light emitting devices or array(s) thereof D1 to D4 may be connected to the current controller 521 without using the switch unit 514. Since the voltage and/or level of the ripple current signal VR is higher than the fourth reference level LV4, the first to fourth light emitting devices or array(s) thereof D1 to D4 may be turned on. Since the voltage Vsns at the first node node1 becomes lower than the unit reference voltage Vled in accordance with turning on the first to fourth light emitting devices or array(s) thereof D1 to D4, the switching controller 520 and/or the logic operation state thereof may be maintained at the first state S1. In this case, the current flowing through the first to third light emitting devices or array(s) thereof D1 to D4 is the fourth reference current Ir4 (e.g., by the current controller 521).

Next, a description will be given for the case in which the voltage and/or level of the ripple current signal VR changes from the maximum level Max to the minimum level Min.

When the voltage and/or level of the ripple current signal VR is lower than the fourth reference level LV4, but equal to or higher than the third reference level LV3, the first to fourth light emitting devices or array(s) thereof D1 to D4 cannot be turned on because the voltage of the ripple current signal VR is lower than the sum of the operating voltages of the first to fourth light emitting devices or array(s) thereof D1 to D4 (i.e., VR<VF1+VF2+VF3+VF4). In this case, accordingly, the switching controller 520 and/or the logic operation state thereof changes from the first state S1 to the second state S2 because the current flowing through the first to fourth light emitting devices or array(s) thereof D1 to D4 is smaller than Ir4. The switching controller 520 and/or the logic operation state thereof in the second state S2 is the same as described above.

When the voltage and/or level of the ripple current signal VR is lower than the third reference level LV3, but equal to or higher than the second reference level LV2, the first to third light emitting devices or array(s) thereof D1 to D3 cannot be turned on because the voltage of the ripple current signal VR is lower than the sum of the operating voltages of the first to third light emitting devices or array(s) thereof D1 to D3 (i.e., VR<VF1+VF2+VF3). In this case, accordingly, the switching controller 520 and/or the logic operation state thereof changes from the second state S2 to the third state S3 because the current flowing through the first to third light emitting devices or array(s) thereof D1 to D3 is smaller than Ir3. The switching controller 520 and/or the logic operation state thereof in the third state S3 is the same as described above.

When the voltage and/or level of the ripple current signal VR is lower than the second reference level LV2, but equal to or higher than the first reference level LV1, the first and second light emitting devices or array(s) thereof D1 and D2 cannot be turned on because the voltage of the ripple current signal VR is lower than the sum of the operating voltages of the first and second light emitting devices or array(s) thereof D1 and D2 (i.e., VR<VF1+VF2). In this case, accordingly, the switching controller 520 and/or the logic operation state thereof changes from the third state S3 to the fourth state S4 because the current flowing through the first and second light emitting devices or array(s) thereof D1 and D2 is smaller than Ir2. The switching controller 520 and/or the logic operation state thereof in the fourth state S4 is the same as described above.

When the voltage and/or level of the ripple current signal VR is lower than the first reference level LV1, the first light emitting device array D1 cannot be turned on. In this case, accordingly, the switching controller 520 and/or the logic operation state thereof is maintained in the fourth state S4 because the current flowing through the first light emitting device array D1 is smaller than Ir1.

The temperature adapter 240 (see, e.g., FIG. 2) measures the temperature of the illumination system 100. Based on the temperature, the temperature adapter 240 adjusts the level of the selection voltage VREF supplied to the sequential driving controller 230. As such, the temperature adapter 240 may control the brightness of the light emitting unit 101.

Figure 11:
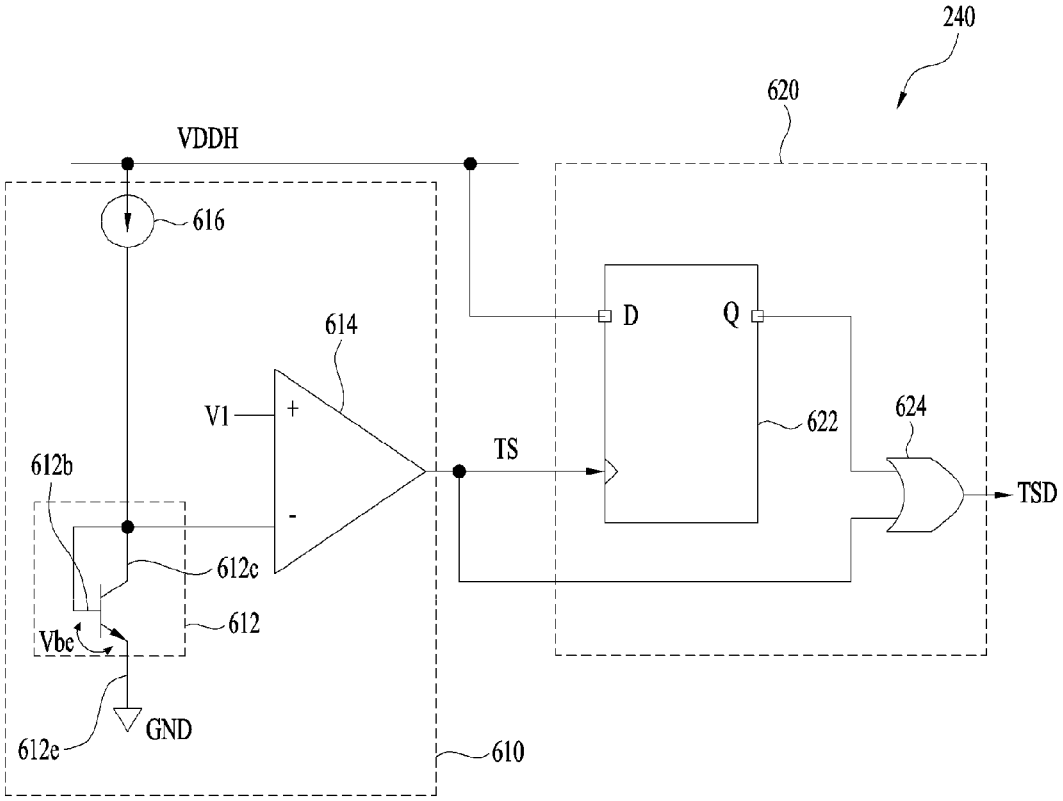
FIG. 11 is a diagram illustrating an embodiment of an exemplary temperature adapter 240 as illustrated in FIG. 2.

FIG. 11 illustrates an embodiment of the exemplary temperature adapter 240 illustrated in FIG. 2. Referring to FIG. 11, the temperature adapter 240 includes a temperature sensing unit 610 and a thermal shutdown signal generator 620.

The temperature sensing unit 610 senses the temperature of the illumination system 100 and compares the sensed temperature with a reference temperature (or currents or voltages corresponding thereto). Based on the result of comparing the sensed temperature with the reference temperature (or the currents or voltages corresponding thereto), the temperature sensing unit 610 may generate a temperature sensing signal TS. In this case, the temperature sensed by the temperature sensing unit 610 may be the temperature of the illumination system 100.

For example, the temperature sensing unit 610 may include a temperature sensing transistor 612, a comparator 614, and a constant current source 616.

The temperature sensing transistor 612 may be implemented as or may comprise a bipolar transistor. The voltage between the base and emitter of the temperature sensing transistor 612, namely, a base-emitter voltage Vbe, may vary in accordance with or as a function of the variation in the temperature of the illumination system 100. For example, as the temperature of the illumination system 100 increases, the base-emitter voltage Vbe of the temperature sensing transistor 612 may drop. Alternatively, the base-emitter voltage may be a gate-source voltage (Vgs) when the temperature sensing transistor 612 is a MOS transistor (e.g., NMOS or PMOS transistor).

The temperature sensing transistor 612 includes a base 612*b*, a collector 612*c* connected to the base 612*b*, and an emitter 612*e* connected to the ground potential GND. Alternatively, the temperature sensing transistor 612 may include a gate, a source connected to the gate, and a drain connected to the ground potential GND.

The comparator 614 may compare the base-emitter voltage Vbe or the gate-source voltage of the temperature sensing transistor 612 with a reference voltage V1, and may generate a temperature sensing signal TS according to the result of the comparison. The reference voltage V1 may correspond to a reference temperature (e.g., 125-150° C.), which may be a set temperature desired or defined by the user.

The comparator 614 may output a temperature sensing signal TS having a first level (for example, a high binary logic level) when the base-emitter voltage Vbe of the temperature sensing transistor 612 is lower than or equal to the reference voltage V1 (i.e., Vbe≤V1). The temperature sensing signal TS having the first level may represent the case in which the temperature of the illumination system 100 is equal to or higher than the reference temperature set by the user.

On the other hand, when the base-emitter voltage Vbe of the temperature sensing transistor 612 is higher than the reference voltage V1 (i.e., Vbe>V1), the comparator 614 may output a temperature sensing signal TS having a second level (for example, a low binary logic level).

The constant current source 616 is connected between the internal voltage VDDH from the power supply 210 and the collector 612*c* of the temperature sensing transistor 612.

The thermal shutdown signal generator 620 may generate the thermal shutdown signal TSD based on the internal voltage VDDH and temperature sensing signal TS. The thermal shutdown signal generator 620 may include a D-flip-flop 622 and a logic gate 624.

The D-flip-flop 622 may receive the internal voltage VDDH and output the received internal voltage VDDH in response to the temperature sensing signal TS. For example, the internal voltage VDDH from the power supply 210 may be an input of the D-flip-flop 622, and the temperature sensing signal TS may be used as a clock signal for the D-flip-flop 622.

The logic gate 624 may logically operate on the temperature sensing signal TS and an output from the D-flip-flop 622, and may generate a temperature shutdown signal TSD in accordance with the result of the logical operation. For example, the logic gate 624 may be an OR gate.

When the temperature of the illumination system 100 is equal to or higher than the reference temperature, the temperature sensing signal TS may have the first level (for example, the high binary logic level). In this case, the thermal shutdown signal TSD may have a first level (for example, a high binary logic level) in response to the temperature sensing signal TS having the first level (for example, the high binary logic level).

When the temperature shutdown signal TSD has the first level, the current adjuster 220 may select and output a lowest one of the selective voltages Vint[1] to Vint[n] (n being a natural number greater than 1 [i.e., n>1]). On the other hand, when the temperature of the illumination system 100 is lower than the reference temperature, the temperature sensing signal TS may have the second level (for example, the low binary logic level). In this case, however, the thermal shutdown signal TSD may be maintained at the first level (for example, the high binary logic level) because the thermal shutdown signal TSD is an output of the D-flip-flop 622. In detail, the input of the D-flip-flop 622 is the internal voltage VDDH and, as such, once the output of the D-flip-flop 622 has the first level, it is maintained at the first level, so long as power is not cut off. To change the output of the D-flip-flop 622 to the second level, the internal voltage VDDH should have the second level.

When the ambient temperature around the illumination system 100 increases (e.g., due to a fire, etc.) and the temperature of the illumination system 100 becomes equal to or higher than the reference temperature set by the user, the current adjuster 220 outputs the lowest selection voltage in accordance with the embodiment. In such a case, the brightness of the light emitting unit 101 may decrease.

Even when the temperature of the illumination system 100 decreases, the light emitting unit 101 is maintained at a low brightness state without being returned to the original brightness state, so long as the internal voltage VDDH does not toggle to a low level (that is, the illumination system 100 is not turned off). The light emitting unit 101 may return to the original brightness state only when the internal voltage VDDH toggles to a low level, that is, when the illumination system 100 is turned off, and then again turned on.

When the illumination system 100 is turned on or off, a surge voltage may be momentarily generated at the ripple current signal VR input to the light emitting unit 101. Sequentially turning the light emitting devices or array(s) thereof D1 to D4 on or off can occur in accordance with the voltage and/or level of the ripple current signal VR.

The protection circuit 250 (see, e.g., FIG. 2) disables the sequential driving controller 230 when a surge voltage is momentarily generated at the ripple current signal VR. As such, the protection circuit 250 protects the first to third switches Q1 to Q3 and light emitting unit 101.

The protection circuit 250 detects the voltage and/or level of the ripple current signal VR at a time when the ripple current signal VR is applied to the light emitting unit 101 after turning the illumination system 100 on. The protection circuit 250 generates an enable signal En to enable or disable the sequential driving controller 230, depending on the detected voltage and/or level of the ripple current signal VR. For example, when the voltage and/or level of the ripple current signal VR is within a predetermined reference voltage range, the protection circuit 250 may activate the enable signal En. On the other hand, when the voltage and/or level of the ripple current signal VR is outside the predetermined reference voltage range, the protection circuit 250 may deactivate the enable signal En.

In accordance with the active enable signal En, the sequential driving controller 230 may be enabled. On the other hand, the sequential driving controller 230 may be disabled when the enable signal En is deactivated.

The predetermined reference voltage range may be a range of voltages that normally operate elements included in the controller. The predetermined reference voltage range may be equal to or higher than a first reference voltage RV1 and equal to or lower than a second reference voltage RV2. For example, when the voltage of the ripple current signal VR is lower than the first reference voltage RV1 or higher than the second reference voltage RV2, the protection circuit 250 may disable the sequential driving controller 230.

The first reference voltage RV1 may be lower than a voltage capable of driving one light emitting device array included in the light emitting unit 101. For example, the first reference voltage RV1 may be lower than the drive voltage of one light emitting device array (for example, 65V) by 10 to 20V. Of course, embodiments are not limited to the above-described condition.

The second reference voltage RV2 may be higher than the sum of the drive voltages of all of the light emitting devices and/or arrays D1 to D4 in the light emitting unit 101. For example, the second reference voltage RV2 may be higher than the sum of the drive voltages of all light emitting devices or array(s) thereof D1 to D4 by 100V or more. Of course, embodiments are not limited to the above-described condition.

Figure 7:
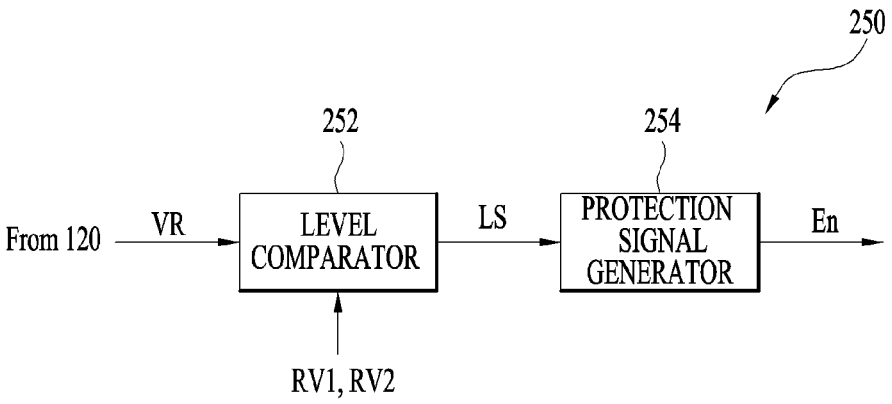
FIG. 7 is a diagram illustrating one or more embodiments of an exemplary protection circuit as illustrated in FIG. 6.

FIG. 7 illustrates an embodiment of the exemplary protection circuit 250 illustrated in FIG. 6. Referring to FIG. 7, the protection circuit 250 may include a level comparator 252 and a projection signal generator 254.

The level comparator 252 detects a voltage and/or level of the ripple current signal VR, and compares the detected voltage and/or level of the ripple current signal VR with the predetermined reference voltages RV1 and RV2. Based on the result of comparing the detected voltage and/or level of the ripple current signal VR with the predetermined reference voltages RV1 and RV2, the level comparator 252 outputs a comparison signal LS.

For example, when the detected voltage and/or level of the ripple current signal VR is lower than the first reference voltage RV1 or higher than the second reference voltage (i.e., VR<RV1 or VR>RV2), the level comparator 252 may output a detection signal LS having a first level (for example, a high binary logic level). On the other hand, when the detected voltage and/or level of the ripple current signal VR is equal to or higher than the first reference voltage RV1 or equal to or lower than the second reference voltage, the level comparator 252 may output a detection signal LS having a second level (for example, a low binary logic level).

The protection signal generator 254 thus outputs an enable signal En to enable or disable the sequential driving controller 230 depending on the state of the detection signal LS. For example, when the detection signal Ls has the first level (for example, a high binary logic level), the protection signal generator 254 may output an enable signal En to enable the sequential driving controller 230. On the other hand, when the detection signal Ls has the second level (for example, a low binary logic level), the protection signal generator 254 does not generate an active enable signal En and, as such, the sequential driving controller 230 is disabled.

For example, when the voltage of the ripple current signal VR at the time that the illumination system 100 is turned on is outside the normal operation voltage range, the detection signal LS has the second level and, as such, the protection signal generator 254 cannot output an active enable signal En. As described in conjunction with FIG. 12, the switching controller 520 is maintained at the start state 5110, and the first to third switches Q1 to Q3 of the sequential driving controller 230 are turned off. Thus, damage to the first to third switches Q1 to Q3 and first to fourth light emitting devices or array(s) thereof D1 to D4 may be prevented.

In embodiments of the present invention, the sequential driving controller 130 may allow current from the light emitting unit 101 to flow to one of the first to fourth channels CH1 to CH4 based on the ripple current signal VR. In various embodiments, it may be possible to adjust the amount of light from the light emitting unit 101 by adjusting the current flowing through the light emitting unit 101, based on the setting voltage Vset determined by the external resistor Rset.

In various embodiments, it may be possible to improve the AC power noise tolerance by preventing AC power noise (for example, fluctuation noise) from influencing the selection voltage VREF.

In various embodiments, it may be possible to prevent the illumination system 100 from turning off or flickering in an abnormal situation such as a fire, and to enable the illumination system 100 to emit a normal amount of light when it is turned on after being turned off.

The embodiments as described above may include particular features, structures, or characteristics, but not every embodiment necessarily includes the particular features, structures, or characteristics. Furthermore, the particular features, structures or characteristics in each embodiment may be combined in any suitable manner, as would be apparent to one of ordinary skill in the art from this disclosure, in one or more embodiments. Therefore, combinations of features of different embodiments are meant to be within the scope of the invention.

What is claimed is:

1. A light emitting device driving apparatus configured to control a light emitting unit including light emitting devices or array(s) thereof connected in series, comprising:

a rectifier configured to rectify an AC signal, and supply to the light emitting unit a ripple current signal;

a switch driver configured to selectively connect the channel lines and the first node in response to control signals;

a current controller connected between the first node and a ground potential, the current controller generating the reference current;

a logic controller configured to adjust the level and/or value of the reference current based on a level of the ripple current signal, and generate the control signals;

a power supply configured to receive the ripple current signal, and generate an internal voltage and the plurality of selective voltages; and a current adjuster configured to select one of the plural selective voltages, wherein the current adjuster comprises:

an external resistor connection terminal connected to an external resistor, an internal resistor connected at one end to the external resistor connection terminal and another end receiving the internal voltage, an analog-digital converter configured to convert an analog signal to a digital value in response to the setting voltage, wherein the setting voltage is a voltage at the external resistor connection terminal, and a selector configured to select one of the plural selective voltages based on the digital value, and output the selected voltage.

2. The light emitting device driving apparatus according to claim 1, wherein the first node is directly connected to a last one of the output terminals of the light emitting devices or array(s) thereof.

3. The light emitting device driving apparatus according to claim 2, further comprising:

a plurality of switches configured to receive one or more control signals, wherein each of the switches is connected between the first node and a corresponding one of the output terminals of the light emitting devices or array(s) thereof, except for the last output terminal.

4. The light emitting device driving apparatus according to claim 2, wherein the current controller comprises:

an amplifier comprising a first input terminal configured to receive a selection voltage, a second input terminal connected to a second node, and an output terminal, a transistor comprising a gate connected to the output terminal of the amplifier, and source and drain terminals connected between the first node and the second node, and a variable resistor connected between the second node and the ground potential; and the logic controller varies a resistance of the variable resistor.

5. An illumination system comprising:

a light emitting unit comprising a plurality of light emitting devices or array(s) thereof connected in series; and a light emitting device driving apparatus configured to control the light emitting unit according to claim 1.

6. A light emitting device driving apparatus configured to control a light emitting unit including light emitting devices or array(s) thereof connected in series, comprising:

a rectifier configured to rectify an AC signal, and output a ripple current signal;

a switch unit comprising a plurality of switches each connected between a first node and a corresponding one of output terminals of the light emitting devices or array(s) thereof, except for a last one of the output terminals;

a current controller connected between the first node and a ground potential, configured to output a reference current; and a logic controller configured to adjust the level and/or value of the reference current based on a level of the ripple current signal, and generate one or more control signals based on a comparison between the level and/or value of the reference current and a channel current from the light emitting unit;

a power supply configured to receive the ripple current signal, and generate an internal voltage and the plurality of selective voltages; and a temperature adapter comprising a temperature sensing transistor having a base-emitter or gate-source voltage varying in accordance with a variation in temperature, the temperature adapter outputting a thermal shutdown signal based on the base-emitter or gate-source voltage of the temperature sensing transistor and the internal voltage, wherein the current adjuster selectively outputs one of the selective voltages based on the thermal shutdown signal.

7. The light emitting device driving apparatus according to claim 6, wherein the current controller comprises:

an amplifier comprising a first input terminal configured to receive a selection voltage, a second input terminal connected to a second node, and an output terminal;

a transistor comprising a gate connected to the output terminal of the amplifier, and source and drain terminals connected between the first node and the second node;

a plurality of resistors connected in series between the second node and a ground potential; and at least one resistive switch connected to opposite ends of at least one of the resistors.

8. The light emitting device driving apparatus according to claim 6, wherein the logic controller controls the at least one resistive switch based on a result of comparing the level and/or value of the reference current and the channel current.

9. The light emitting device driving apparatus according to claim 6, further comprising an amplifying unit configured to amplify the control signals and supply amplified control signals to the switches.

10. The light emitting device driving apparatus according to claim 9, further comprising a protection circuit configured to detect a voltage and/or level of the ripple current signal, and generate an enable signal to enable the amplifying unit when a detected voltage and/or level of the ripple current signal is within a predetermined reference voltage range.

11. The light emitting device driving apparatus according to claim 6, wherein the temperature adapter further comprises:

a comparator configured to compare the base-emitter or gate-source voltage of the temperature sensing transistor with a first voltage, and output a temperature sensing signal;

a D-flip-flop configured to receive and output the internal voltage in response to the temperature sensing signal; and a logic gate configured to logically operate on the internal voltage from the D-flip-flop and the temperature sensing signal, and output the thermal shutdown signal.

* * * * *